US005815792A

United States Patent [19]

Duquenne et al.

[11] Patent Number: 5,815,792

[45] Date of Patent: Sep. 29, 1998

[54] NICKEL-BASED SUPERALLOYS WITH HIGH TEMPERATURE STABILITY

[75] Inventors: Catherine Duquenne, Paris; Jean Charles Henri Lautridou, Bondoufle; Michel Marty, Buc; Michèle Soucail, Fontenay Aux Roses; André Walder, L'Hay Les Roses, all of France

[73] Assignee: Societe Nationale d'Etude et de Construction de Moteurs d'Aviation "Snecma", Paris, France

[21] Appl. No.: 689,157

[22] Filed: Jul. 30, 1996

[30] Foreign Application Priority Data

Aug. 9, 1995 [FR] France ..... 95 09653

[51] Int. Cl.[6] ..... B22F 1/00; B22F 5/00; B22F 5/04; C22C 19/05

[52] U.S. Cl. ..... 419/67; 75/246; 148/410; 148/428; 148/419; 148/442; 420/448; 420/449; 420/588

[58] Field of Search ..... 75/246; 148/410, 148/428, 404, 514; 420/448, 449, 588; 415/200; 416/200, 241 R, 223 R; 419/33, 41, 28, 29, 67, 64

[56] References Cited

U.S. PATENT DOCUMENTS

| | | | |
|---|---|---|---|
| 3,147,155 | 9/1964 | Lamb . | |
| 4,867,812 | 9/1989 | Henry | 148/410 |
| 5,080,734 | 1/1992 | Krueger et al. | 148/410 |
| 5,104,614 | 4/1992 | Ducrocq et al. . | |
| 5,120,373 | 6/1992 | Miller et al. . | |
| 5,129,971 | 7/1992 | Henry | 148/428 |
| 5,143,563 | 9/1992 | Krueger et al. | 148/410 |
| 5,482,789 | 1/1996 | O'Hara et al. | 148/404 |

FOREIGN PATENT DOCUMENTS

| | | |
|---|---|---|
| 0 237 378 | 9/1987 | European Pat. Off. . |
| 0 421 228 | 4/1991 | European Pat. Off. . |
| 0 421 229 | 4/1991 | European Pat. Off. . |
| 2 628 349 | 9/1989 | France . |
| WO 94/13849 | 6/1994 | WIPO . |

*Primary Examiner*—Margery Phipps
*Attorney, Agent, or Firm*—Oblon, Spivak, McClelland, Maier & Neustadt, P.C.

[57] ABSTRACT

A nickel-based superalloy possessing good mechanical properties when hot regarding traction, creep and cracking resistance has a chemical composition which comprises, in percentages by weight: Co 14.5 to 15.5 ; Cr 12 to 15 ; Mo 2 to 4.5 : Al 2.5 to 4; Ti 4 to 6; Hf not more than 0.5 ; C 100 to 300 ppm; B 100 to 500 ppm; Zr 200 to 700 ppm; possibly W up to 4.5; and nickel as the remainder. Components made from these alloys have an excellent microstructural stability when operating at temperatures up to 800° C.

17 Claims, 6 Drawing Sheets a b

COMPARATIVE

COMPARATIVE

COMPARTIVE

COMPARATIVE

NICKEL-BASED SUPERALLOYS WITH HIGH TEMPERATURE STABILITY

BACKGROUND OF THE INVENTION

1. Field of the invention

The present invention relates to a nickel-based super-alloy composition which is stable and has good mechanical properties at high temperatures, and is particularly concerned with such a superalloy which can be produced by powder metallurgy (PM) for forming a turbojet engine rotor disk able to operate at temperatures up to 750° C. under severe mechanical loading and with a working life of several tens of thousands of hours.

Components such as these need to be made of a homogenous material of moderate density and meeting certain criteria relating to mechanical properties such as traction, creep, oligocyclic fatigue and resistance to crack propagation at temperatures up to 750° C.

2. Summary of the prior art

Superalloys currently produced by powder metallurgy can be used for high temperature applications but do not possess sufficient structural stability for lengthy use. During use, and at temperatures in excess of 650° C., weakening phases termed TCP (topologically close packed) phases precipitate and degrade the mechanical properties of the alloy. For example, in FIG. 1 showing the TTT (time-temperature-transformation) curve of a nickel-based superalloy A in accordance with EP-A-0237378, zone 1 shows that for the range of temperatures between 600° and 850° C. the TCP phases appear more rapidly as the temperature of use is higher. Zone 2 defines the conditions for the appearance of intergranular carbide precipitates also having an influence on the instability of the alloy. Results of creep with elongation of 0.2% are shown in FIG. 2 where the curves 1 and 2 are the envelopes of the points obtained at temperatures ranging from 650° C. to 750° C. by plotting the stress values in MPa relative to LARSON-MILLER's coefficient m, wherein T represents the temperature in degrees Kelvin and t the time in hours, for an alloy A aged at 700° C. for 2000 hours, and the curves 3 and 4 are the envelopes of the points obtained for alloy A in the non-aged state. These results show that after aging the creep time for reaching 0.2% plastic elongation is as much as 10 times less than for the non-aged material. It is thus clear that for applications such as turbojet engine rotor disks, operating at high temperatures (>700° C.) for several tens of thousands of hours, it is essential to use superalloys which are stable throughout the range of use envisaged.

Nickel-based superalloys generally possess a structure composed of two phases, namely:

a gamma austenitic phase of Ni-based composition, enriched with Co and hardened mainly by elements in solid solution such as Mo, Cr, W; and, a hardening, dispersed gamma-prime intermetallic phase of $Ni_3Al$ type, in which mainly Co and Cr may substitute for Ni while Ti and Nb preferentially substitute for Al.

The required level of mechanical characteristics and stability may be obtained by intervention in the methods of hardening of the two phases, which leads to specifying the content of each of the elements.

SUMMARY OF THE INVENTION

In order to improve the stability of such superalloys, or to render them thermodynamically more stable, it is necessary to act on the chemical composition of the gamma phase.

Accordingly, the invention provides a nickel-based superalloy possessing good mechanical properties when hot regarding traction, creep and cracking resistance, wherein the chemical composition of said superalloy comprises, in percentages by weight:

Co 14.5 to 15.5%

Cr 12 to 15%

Mo 2 to 4.5%

W 0 to 4.5%

Al 2.5 to 4%

Ti 4 to 6%

Hf not more than 0.5%

C 100 to 300 ppm

B 100 to 500 ppm

Zr 200 to 700 ppm

Ni as the balance, and wherein the sum of the atomic concentrations of gamma-prime-gene elements (Al+Ti+Hf) in the alloy is between 11.5 and 14.5%, boundary figures included, corresponding to a gamma-prime phase volume fraction estimated at a value of between 40 and 58%, the sum of the atomic concentrations of gamma-gene elements (Mo+W+Cr) in the alloy is between 14.5 and 19%, boundary figures included, and a computed value for the stability criterion Md is situated between 0.900 and 0.915, boundary figures included, so as to ensure an excellent microstructural stability at temperatures up to 800° C.

The invention and its preferred features and advantages will now be described in more detail with reference to preferred examples of the superalloy composition of the invention, and with reference to the attached drawings.

DETAILED DESCRIPTION OF THE INVENTION AND EXAMPLES

SPECIFICATION OF Al, Ti, Nb, Hf; GAMMA-PRIME-GENE ELEMENTS

Figure 1:
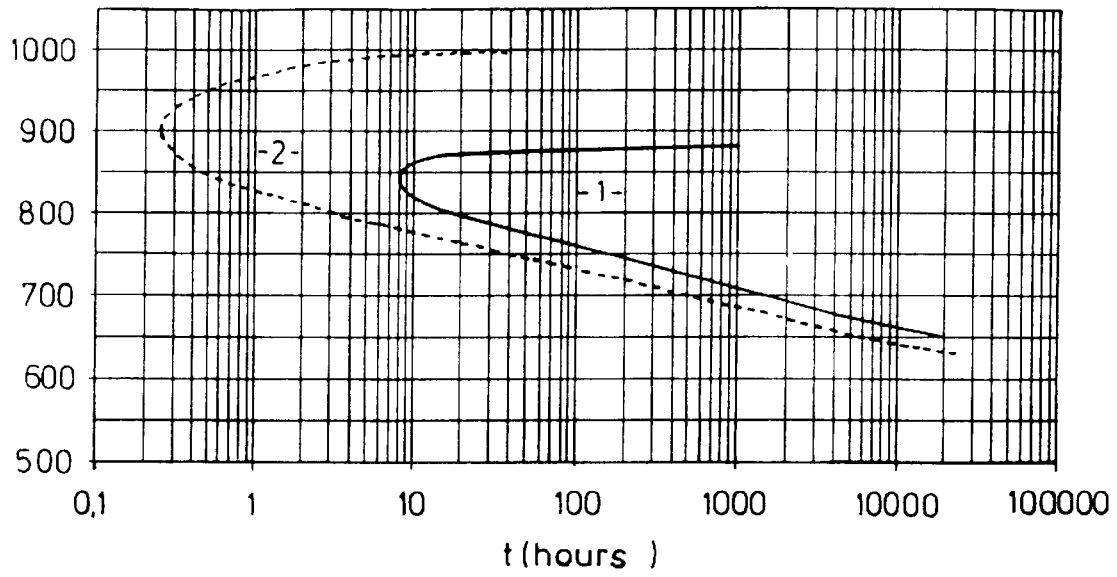
FIG. 1 is a diagram showing the TTT (time-temperature-transformation) curve for a known superalloy composition A as described earlier.

The gamma-prime phase in which the gamma-prime-gene elements are concentrated performs a dominant role in the mechanical behaviour of nickel-based superalloys, both in respect of hardening, because of the interaction between the gamma and gamma-prime phases and also as a consequence of the homogeneity of deformation, and in respect of the interaction with the environment, since this phase constitutes a privileged source of aluminum. The volume fraction of the gamma-prime phase in a superalloy is therefore an important parameter which can be easily varied by playing with the content of the gamma-prime-gene elements: Al, Ti, Nb, Hf.

For the alloys of the invention, the volume fraction of the gamma-prime phase has been set at a value between 0.40 and 0.58, this being obtained by taking a sum of the concentrations by weight of the gamma-prime-gene elements (Al+Ti+Nb+Hf) in the alloy of between 8 and 10%, corresponding to a sum of the atomic concentrations of these elements in the alloy of between 11.5 and 14.5%.

Preferably the contents of Al and Ti are such that their ratio Ti/Al is from 1.3 to 2.4 (calculated as percentages by weight). The substitution of titanium for aluminum is known to promote the hardening of the gamma-prime phase beyond 650° C., but it must be restricted, as, beyond a certain titanium fraction in the gamma-prime phase, the latter is transformed from a phase of type $Ni_3Al$ into a non-reinforcing phase of type $Ni_3Ti$.

In spite of the favourable effect of Nb on the elastic limit of nickel-based superalloys, this element is not used in the alloys of the present invention as it has an unfavourable effect on the crack resistance in fatigue-creep beyond 650° C., as is shown by results given hereinbelow.

SPECIFICATION OF Co

Cobalt is an element which divides fairly equitably between the gamma and gamma-prime phases with, however, some advantage in favour of the gamma-prime phase. Its weight concentration for the alloys of the invention has been set at about 15%. This content represents a good compromise, allowing the enjoyment of the advantages afforded by the presence of cobalt in superalloys, in particular its favourable influence on creep resistance, while restricting its unfavourable influence relative to that of nickel on the microstructural stability of the alloy. For example, the Nimonic 80A alloy (Ni; 19.5% Cr; 1.4% Al, 2.4k Ti), which does not contain cobalt, achieves in a creep-rupture test at 760° C., a life of 1000 hours under a stress of 160 MPa, whereas for the Nimonic 90 alloy (Ni; 19.5% Cr; 16.5% Co; 5% Al; 2.5 Ti) containing 16.5% cobalt, the stress required to obtain the same length of life at the same temperature is equal to 205 MPa (ref. C. T. SIMS, Norman S. Stoloff, W. C. Hagel, "Superalloys II", published by John Wiley & Sons, New York, 1986 pages 594 and 596).

SPECIFICATION OF Cr. Mo. W:GAMMA GENE ELEMENTS

Chromium, by concentrating preferentially in the gamma phase, plays an essential part in the resistance of the alloy to the effects of the environment at a high temperature.

The chromium content of the alloys of the invention is preferably set so as to achieve a 25 atomic concentration of Cr in the gamma phase, the atomic concentration $C_{cr}$ of chromium in the alloy being defined relative to the atomic fraction of gamma phase by the ratio:

$$C_{cr}=25\times(1-0.867\ F.)$$

Concentrations in the alloy of Mo or of (Mo+W) have been adjusted so that the composition of the matrix should not bring about the formation of a TCP phase of type σ. The New-Phacomp calculation method based on the computation of the electronic structures and proposed by Morinaga et al. (cf. M. Morinaga, N. Yakawa, H. Adachi, H. Ezaki, TMS-AIME, Warrendale, Pa., 1984, p. 525) was used for this purpose. It is characterized by the use of a stability criterion termed "Md", the calculation of which is explained later. For the alloys of the invention, the computed value of the Md stability criterion is always between 0.900 and 0.915, or is equal to one of these two values. The concentrations of Mo or (Mo+W) were therefore adjusted so the value of Md is within this set range.

The following Tables T and I bis give the compositions, in percentages by weight and atomic percentages respectively, of known superalloys A, B, C, D, E, F, G and of superalloys NR3, NR4 and NR6 in accordance with the invention, nickel making up the balance in each case.

| % W | A | B | C | D | E | F | G | NR 3 | NR 4 | NR 6 |
|---|---|---|---|---|---|---|---|---|---|---|
| Cr | 011.5 | 14.0 | 15.0 | 17.9 | 16.5 | 12.5 | 12.4 | 12.5 | 14.4 | 13.9 |
| Co | 15.7 | 8.0 | 16.5 | 14.7 | 13.5 | 18.6 | 18.5 | 14.9 | 14.18 | 15.3 |
| Mo | 6.5 | 3.5 | 5.0 | 3.0 | 4.2 | 3.3 | 3.2 | 3.55 | 4.6 | 2.2 |
| W | 0 | 3.5 | 0 | 1.3 | 4.2 | 0 | 0 | | | 3.7 |
| Al | 4.35 | 3.5 | 4.0 | 2.5 | 2.3 | 4.9 | 5.0 | 3.6 | 2.5 | 2.9 |
| Ti | 4.35 | 2.5 | 3.5 | 5.0 | 3.9 | 4.5 | 4.3 | 5.5 | 5.8 | 4.6 |
| Nb | 0 | 3.5 | 0 | 0 | 0.8 | 1.8 | 0 | | | |
| Hf | 0.5 | 0 | | | | | | 0.3 | 0.4 | 0.3 |
| V | 0.9 | | | | | | | | | |
| C | | | | | | | | 0.02 | 0.02 | 0.02 |
| B | | | | | | | | 0.01 | 0.03 | 0.01 |
| Zr | | | | | | | | 0.05 | 0.0 | 0.06 |

| | H | I | J | K |
|---|---|---|---|---|
| Cr | 15 | 15 | 15 | 15 |
| Co | 25 | 15 | 19.5 | 13.6 |
| Mo | 4.25 | 3.75 | 4.25 | 4.1 |
| Al | 3.925 | 4.925 | 7.75 | 2.2 |
| Ti | 4.7 | 3.55 | 0 | 4.6 |
| C | 0.105 | 0.105 | 0.105 | 0.01 |
| B | 0.0514 | 0.0515 | 0.0515 | 0.007 |
| Zr | 0.105 | 0.105 | 0.105 | 0.07 |

TABLE I

| | A | B | C | D | bis E | F | G | NR 3 | NR 4 | NR 6 |
|---|---|---|---|---|---|---|---|---|---|---|
| Cr | 12.4 | 15.5 | 16.05 | 19.3 | 18.45 | 13.3 | 13 | 13.4 | 15.6 | 15.3 |
| Co | 14.9 | 7.8 | 15.6 | 14 | 13.3 | 17.5 | 17.2 | 14.1 | 14.15 | 14.8 |
| Mo | 3.8 | 2.1 | 2.9 | 1.8 | 2.55 | 1.9 | 1.8 | 2.1 | 2.7 | 1.3 |
| W | | 1.1 | | 0.4 | 1.3 | | | | | 1.1 |
| Al | 9 | 7.5 | 8.25 | 5.2 | 5 | 10.05 | 10.1 | 7.4 | 5.2 | 6.1 |
| Ti | 5.1 | 3 | 4.1 | 5.9 | 4.7 | 5.2 | 4.9 | 6.4 | 6.8 | 5.45 |
| Nb | | 2.2 | | | 0.5 | 1.1 | | | | |
| Hf | 0.1 | | | | | | | 0.1 | 0.1 | 0.1 |
| | | | | | | | V0.9 | | | |
| Al + Ti + Hf | 14.3 | 12.7 | 12.35 | 11.2 | 10.2 | 16.35 | 15 | 13.9 | 12.1 | 11.65 |
| Cr + M + W | 16.2 | 18.7 | 18.95 | 21.5 | 22.3 | 15.2 | 14.8 | 15.5 | 18.3 | 17.7 |

| | H | I | J | K |
|---|---|---|---|---|
| Al + Ti + Nb + Hf | 13.43 | 14 | 15.34 | 10.03 |
| Cr + Mo + W | 18.35 | 17.87 | 17.77 | 18.7 |

Alloy A is in conformity with EP-A-0237378 as mentioned earlier.

Alloy B is known by the trade name RENE 95

Alloy C is known by the trade name ASTROLOY

Alloy D is known by the trade name U720

Alloy E is known by the trade name RENE 88

Alloy F is known by the trade name MERL 76

Alloy G is known by the trade name IN 100.

Alloys H, I and J are in conformity with U.S. Pat. No. 3,147,155

Alloy K is in conformity with WO-A-94.13849.

STABILITY CRITERION (Md)

Figure 3:
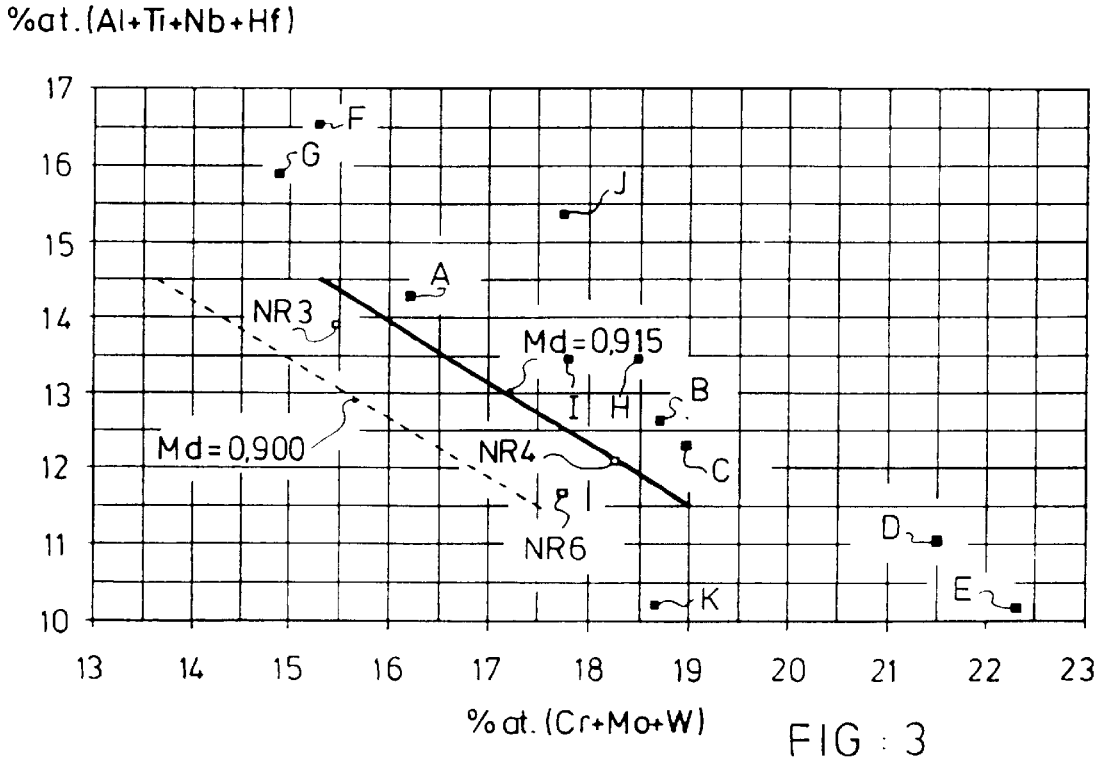
FIG. 3 is a diagram illustrating the atomic compositions of superalloys of the invention relative to those of known superalloys.
Figure 2:
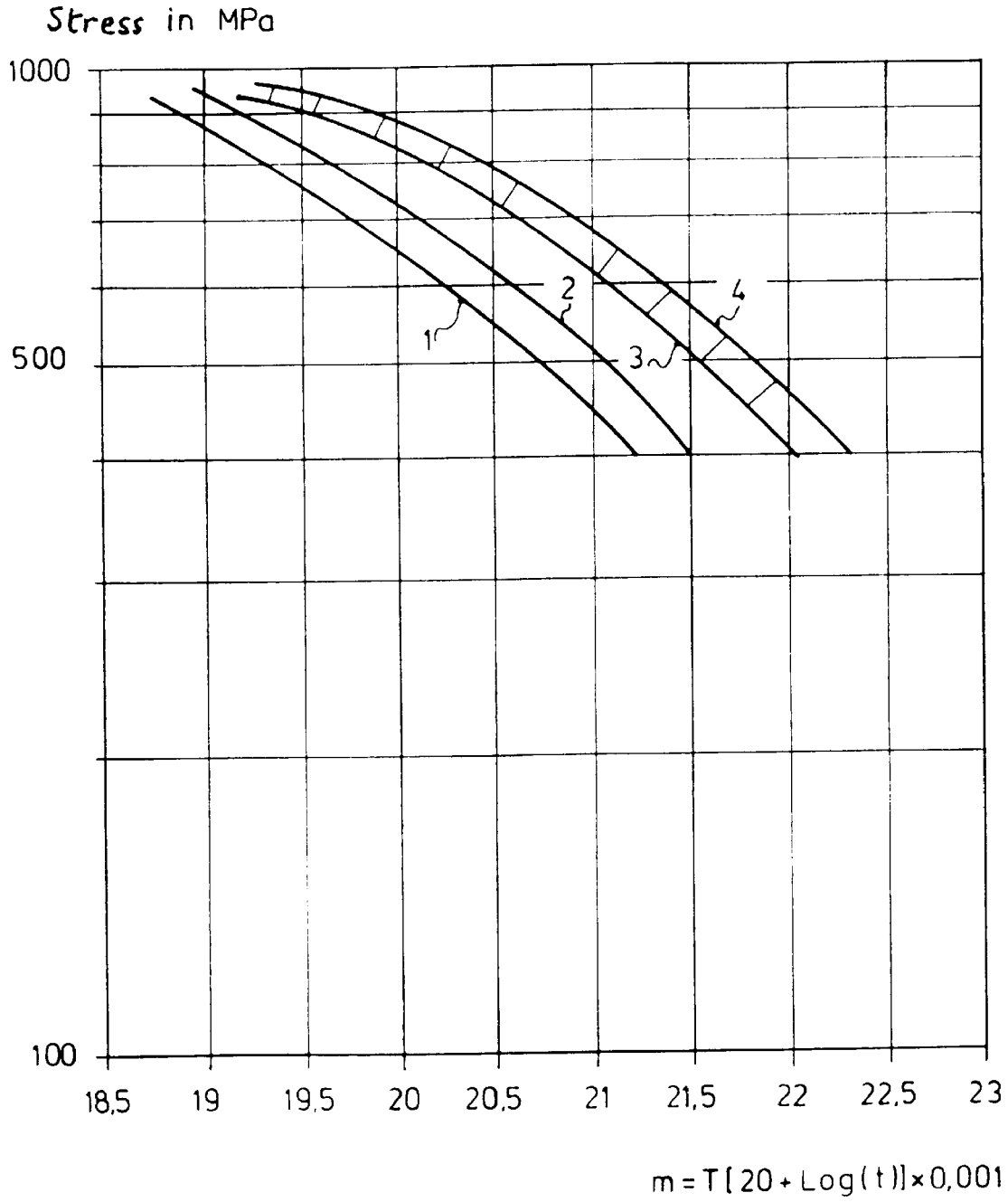
FIG. 2 is a diagram showing the results of creep resistance at 0.2% elongation for the known alloy A in a standard state and in a more aged standard state as described earlier.

In order to compare different superalloys with each other it is possible to display them in a simplified diagram as plotted in FIG. 3, the ordinate representing the sum of the atomic concentrations of the gamma-prime-gene elements (atomic percentage Al+Ti+Nb+Hf) and the abscissa representing the sum of the atomic concentrations of the gamma-gene elements (atomic percentage Cr+Mo+W).

Moreover, based on:

the values of the splitting coefficient Hi, summarized in the table below and used for the calculation of the Ci gamma and $C_i$ gamma-prime compositions, respectively atomic concentrations of the element i in the gamma phase and in the gamma-prime phase, $$Hi = Ci\ \text{gamma-phase}/Ci\ \text{gamma} \quad (1)$$

and the relation first linking the atomic concentration Ci of element i in the alloy with the concentrations of this element i in the gamma phase (Ci gamma) and in the gamma-phase (Ci gamma-prime)

$$C_i = (1-F)\times C_i\ \text{gamma} + F\times Ci\ \text{gamma-prime} \quad (2)$$

wherein F is the atomic fraction of the gamma-prime phase in the alloy, the stability criterion Md can be defined and calculated as follows:

$$Md = \sum_{i=1}^{i=n} Md_i \times Ci\ \text{gamma} \quad (3)$$

| | Ni | Co | Cr | Mo | W | Al | Ti | Hf | Nb |
|---|---|---|---|---|---|---|---|---|---|
| $M_i$ | 58.7 | 58.9 | 52 | 95.9 | 183.9 | 27 | 47.9 | 178.5 | 92.9 |
| $Md_i$ | 0.717 | 0.777 | 1.142 | 1.150 | 1.655 | 1.900 | 2.271 | 3.02 | 2.117 |
| $H_i$ | 1.28 | 0.345 | 0.133 | 0.314 | 0.833 | 4.06 | 10.31 | 20 | 20 |

where: $M_i$ is the atomic mass of the element i;

$Md_i$ is the value of the elementary Md assigned to each of the major elements in the superalloy composition; and $H_i$ is the value of the splitting coefficient used for the computation of the compositions of the gamma and gamma-prime phases ($H_i$>1 for gamma-prime-gene elements and $H_i$<1 for gamma-gene elements).

It is therefore possible to assign a value for the stability criterion Md to each of the alloys in the diagram of FIG. 3 as follows:

| Alloy: | A | B | C | D | E | F | G |
|---|---|---|---|---|---|---|---|
| Md: | 0.935 | 0.924 | 0.926 | 0.921 | 0.928 | 0.947 | 0.935 |
| Alloy: | NR3 | NR4 | NR6 | H | I | J | K |
| Md: | 0.909 | 0.915 | 0.906 | 0.9327 | 0.9265 | 0.9538 | 0.8969 |

With the weight content of Co set at 15%, the range corresponding to values of the stability criterion Md between 0.900 and 0.915 is situated between the two straight lines in the diagram of FIG. 3, and the alloys of the invention are located within this range, boundary figures included.

Thus, the alloys of the invention are distinguished from the other alloys not only by their chemical composition in the ratio of the elements contained, but also according to the values of the stability criterion Md, each point in the diagram corresponding to a single alloy. Alloys of the invention having a chemical composition within the range defined earlier may be defined by the following three complementary conditions:

$$11.5<\Sigma\text{gamma-prime-genes (atomic \% (Al+Ti+Nb+Hf))}\leqq 14.5 \quad (1)$$

$$14\leqq\Sigma\text{gamma-genes (atomic \% (Mo+W+Cr))}\leqq 19 \quad (2)$$

$$0.900\leqq Md\leqq 0.915 \quad (3)$$

REALIZATION OF THE MATERIALS—EXAMPLES—TEST RESULTS

The alloys of the invention were produced by powder metallurgy, the working of the alloys involving a number of steps, as follows:

pulverization by rotating electrodes;

extrusion;

solution heat treatment consisting of a first stage at a temperature above that of the gamma-prime solvus (gamma-prime solvus +5° to 10° C.), followed by a second stage at a temperature lower by 20° to 25° C. than the preceding stage; and ageing treatment for 24 hours at 700° C.+4 hours at 800° C.

All the mechanical tests carried out within the framework of the invention were conducted on specimens cooled at a rate of 100° C./min after the solution treatment. This rate corresponds to a mean cooling rate for components which could possibly be made from an alloy in accordance with the invention.

For each type, mechanical tests on specimens were conducted at 750° C.

Table II below summarizes the results obtained in traction tests at 750° C. with R representing maximum tensile strength, R 0.02% representing traditional elastic limit for an elongation of 0.2%, and A representing breaking elongation.

TABLE II

| | | Traction at 750° C. | | |
|---|---|---|---|---|
| Alloy | Heat treatment | R (MPa) | R 0.2% (MPa) | A (%) |
| A | | | 1005 | 19.7 |
| A | 1200° C./1 h + 700° C./24 h + 800° C./4 h | 1178 | 1001 | 11.5 |
| E | | 1075 | 840-3s | |
| | | 1170 | 980 moy | |
| B | | 1100 | 830-3s | 3% |
| | | 1180 | 1000 moy | |
| C | | 900 | 750-3s | 3% |

TABLE II-continued

| | | Traction at 750° C. | | |
|---|---|---|---|---|
| Alloy | Heat treatment | R (MPa) | R 0.2% (MPa) | A (%) |
| | | 1020 | 850 moy | 8% |
| NR3 | 1210° C./16 h + 1190° C./1 h + 700° C./24 h + 800° C./4 h | 1097 | 969 | 21 |
| NR4 | 1185° C./1 h + 1160° C./1 h 700° C./24 h + 800° C./4 h | 1109 | 961 | 12.2 |
| NR6 | 1185° C. C/1 h + 1160° C./1 h + 700° C./24 h + 800° C./4 h | 1111 | 960 | 16.1 |

Table III below summarizes the results obtained in smooth creep tests at 750° C. under a 600 MPa load, with t 0.2% being the time in hours taken to reach a plastic deformation of 0.2%, $t_r$ being the time in hours taken to reach breaking point, and A% being the elongation at rupture.

TABLE III

| SMOOTH CREEP AT 750° C. UNDER 600 MPa | | | |
|---|---|---|---|
| ALLOY | t 0.2% | tr | A% |
| A | 9 | 109 | 6.8 |
| A | 25 | 59 | 1 |
| C | 2 | 34 | |
| | (15) | (100) | |
| B | ½ | 5 | |
| | (5) | (20) | |
| E | 3 | 50 | |
| | (30) | (70) | |
| NR3 | 38 | 180 | 3.9 |
| NR6 | 20 | 149 | 10.9 |

Table IV below summarizes the results obtained in crack propagation tests in air using creep fatigue at 750° C. carried out after pre-fissuring at 650° C. at a frequency of 20 Hz, the propagation cycle being as follows: load increased to maximum over 10 seconds; maximum load maintained for 300 seconds; load decreased over 10 seconds under a load ratio of 0.05, and with different values of initial Delta K, expressing the initial variation of the stress intensity factor.

TABLE IV

| ALLOY | INITIAL STRESS (MPa) | LENGTH OF INITIAL FISSURING (mm) | FATIGUE-CREEP AT 750° C. NUMBER OF CYCLES BEFORE BREAKING |
|---|---|---|---|
| C | 142 | 5 | 27 |
| A | 166 | 5 | 34 |
| NR3 | 172 | 5,22 | 150 |
| NR4 | 179 | 5,54 | 530 |
| NR6 | 168 | 5 | 510 |

The results show that superalloys of the invention exhibit an optimum set of mechanical properties at high temperatures, combining good results in terms of crack propagation resistance with good tensile strength and creep resistance results, as compared with previously known alloys.

Figure 4:
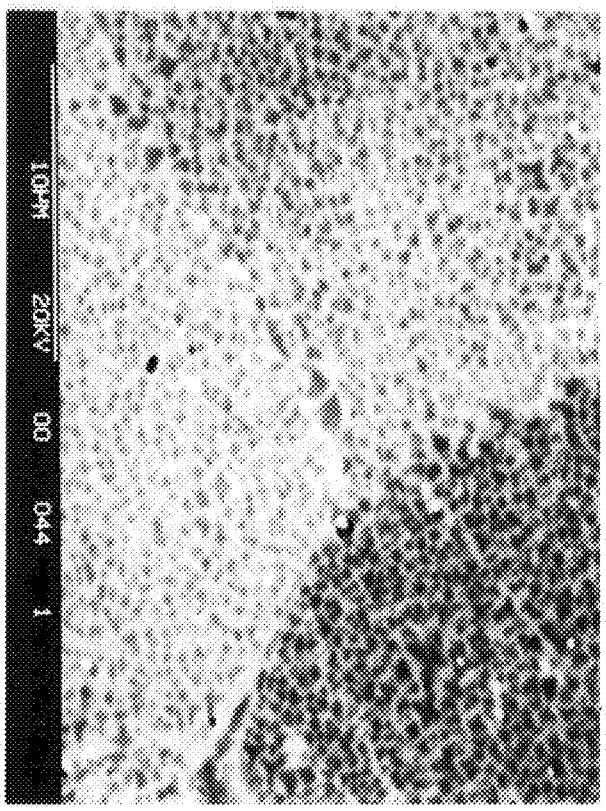
FIG. 4 is a microphotograph of the microstructure of the known superalloy A in a standard treated state.
Figure 5:
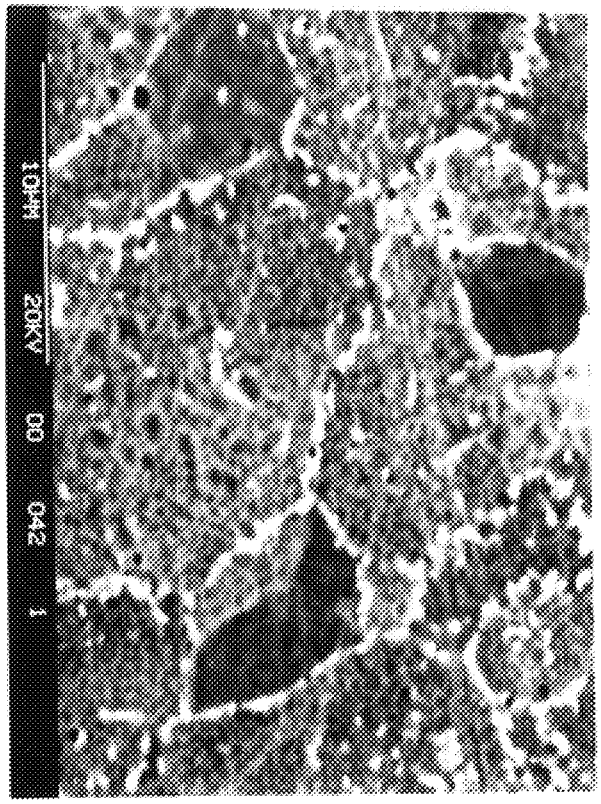
FIG. 5 is a microphotograph of the superalloy A in the treated state aged at 750° C. for 500 hours.
Figure 6:
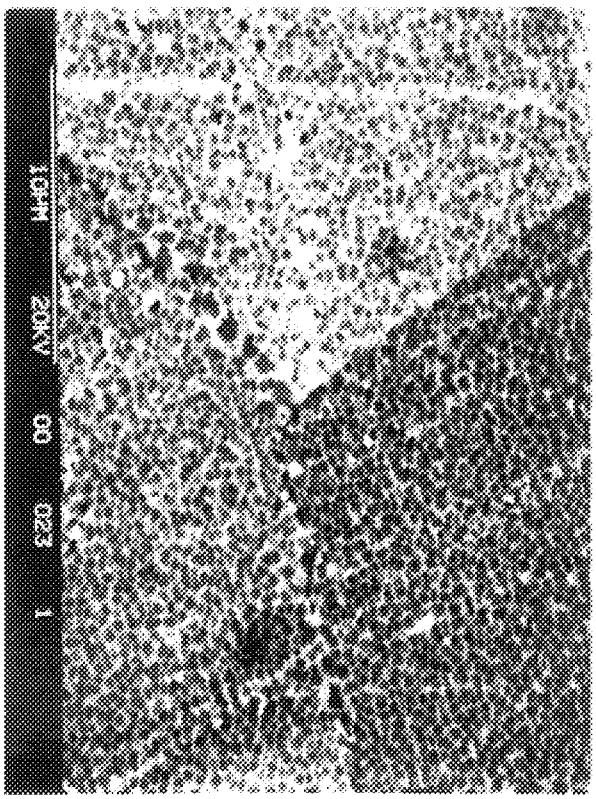
FIG. 6 is a microphotograph similar to that of FIG. 4, but showing the microstructure of an alloy of the invention in the treated state; and, FIG. 7 is a microphotograph similar to that of FIG. 5, but showing the microstructure of an alloy of the invention in the more aged treated state.
Figure 7:
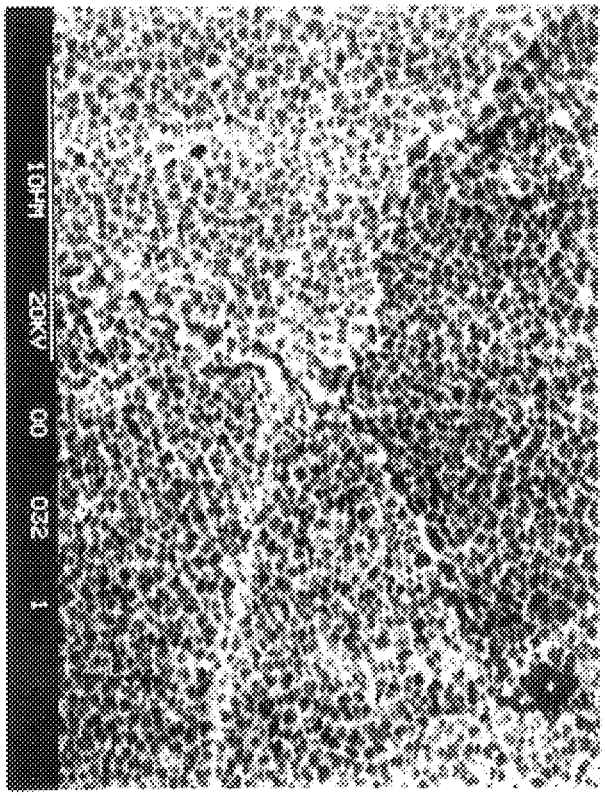

The microstructural state of alloy A and of the alloys of the invention has been characterized in the standard treated state and in a treated and aged state (standard treated state+heat ageing treatment at 750° C. for 500 hours) by means of scanning electron microscopic observations on unattacked specimens and examined by backscattered electron contrast. FIG. 4 is representative of the microstructure of alloy A in the standard treated state, and FIG. 5 shows the microstructure of alloy A observed in the aged treated state. Ageing brings about a precipitation in this alloy which is chiefly intergranular and considered to be responsible for the unfavourable evolution of certain mechanical properties such as creep resistance. In contrast, for the alloys of the invention, the microstructure does not evolve substantially during the ageing treatment, as shown by the comparison of FIGS. 6 and 7 relating respectively to the standard treated state and to the aged treated state of alloy NR3.

The working of components made of the alloys may include, after the extrusion operation, an isothermal forging operation, and, as a variant, the heat treatment may include a solution heat step at a temperature 5° to 50° C. less than that of the gamma-prime solvus of the alloy.

We claim:

1. A nickel-based superalloy consisting essentially of, in percentages by weight:

Co 14.5 to 15.5%

Cr 12 to 15%

Mo 2 to 4.6%

W 0 to 4.5%

Al 2.5 to 4%

Ti 4to 6%

Hf not more than 0.5%

C 100 to 300 ppm

B 100 to 500 ppm

Zr 200 to 700 ppm

Ni as the balance, wherein the sum of the atomic concentrations of gamma-prime-gene elements (Al+Ti+Hf) is $11.5\% \leqq (Al+Ti+Hf) \leqq 14.5\%$, the sum of the atomic concentrations of gamma-gene elements (Mo+W+Cr) in the alloy is $14.5\% \leqq (Mo+W+Cr) \leqq 19\%$, and a computed value for the stability criterion Md is $0.900 \leqq Md \leqq 0.915$, and wherein the microstructure of said alloy does not evolve substantially during an aging treatment at 750° C. for 500 hours.

2. A nickel-based superalloy according to claim 1, wherein the ratio of the concentration by weight of titanium to the concentration by weight of aluminum in the alloy is not less than 1.3 and not more than 2.4.

3. A nickel-based superalloy according to claim 2, wherein the atomic concentration of Cr in the alloy is such that the atomic concentration of chromium in the gamma phase of the alloy is substantially 25% by weight.

4. A nickel-based superalloy according to claim 3, wherein the composition of the superalloy consists of, in percentages by weight:

Co 14.9%

Cr 12.5%

Mo 3.55%

Al 3.6%

Ti 5.5%

Hf 0.3%

C 0.02%

B 0.01%

Zr 0.05% and nickel as the remainder.

5. A nickel-based superalloy according to claim 3, wherein the composition of the superalloy consists of, in percentages by weight:

Co 15.3%

Cr 13.9%

Mo 2.2%

W 3.7%

Al 2.9%

Ti 4.6%

Hf 0.3%

C 0.02%

B 0.01%

Zr 0.06% and nickel as the remainder.

6. A nickel-based superalloy according to claim 3, wherein the composition of the superalloy consists of, in percentages by weight:

Co 14.8%

Cr 14.4%

Mo 4.6%

Al 2.5%

Ti 5.8%

Hf 0.4%

C 0.02%

B 0.03%

Zr 0.05% and nickel as the remainder.

7. A nickel-based superalloy according to claim 1, wherein said superalloy is manufactured from powders.

8. A nickel-based superalloy according to claim 7, wherein said superalloy is worked by extrusion, isothermal forging and heat treatment, including a solution heat step at a temperature 5° to 10° C. higher than that of the gamma-prime solvus of the alloy.

9. A nickel-based superalloy according to claim 7, wherein said superalloy is worked by extrusion, isothermal forging and heat treatment, including a solution heat step at a temperature 5° to 50° C. lower than that of the gamma-prime solvus of the alloy.

10. The nickel-based superalloy of claim 1, consisting essentially of, in percentages by weight:

Co 14.8–15.3%

Cr 12.5–14.4%

Mo 2.2–4.6%

W 0–3.7%

Al 2.5–3.6%

Ti 4.6–5.8%

Hf 0.3–0.4%

C 100 to 300 ppm

B 0.01–0.03%

Zr 0.05–0.06%, and

Ni as the balance.

11. The nickel-based superalloy of claim 1, consisting of, in percentages by weight:

Co 14.8–15.3%

Cr 12.5–14.4%

Mo 2.2–4.6%

W 0–3.7%

Al 2.5–3.6%

Ti 4.6–5.8%

Hf 0.3–0.4%

C 100 to 300 ppm

B 0.01–0.03%

Zr 0.05–0.06%, and

Ni as the balance.

12. A method of making the nickel-based superalloy of claim 1, comprising:

pulverization;

extrusion;

a first stage of solution heat treatment above the gamma-prime solvus;

a second stage of solution heat treatment at a temperature 20°–25° C. lower than the temperature of said first stage of solution heat treatment; and ageing.

13. A method of making the nickel-based superalloy of claim 4, comprising:

pulverization;

extrusion;

a first stage of solution heat treatment above the gamma-prime solvus;

a second stage of solution heat treatment at a temperature 20°–25° C. lower than the temperature of said first stage of solution heat treatment; and ageing.

14. A method of making the nickel-based superalloy of claim 5, comprising:

pulverization;

extrusion;

a first stage of solution heat treatment above the gamma-prime solvus;

a second stage of solution heat treatment at a temperature 20°–25° C. lower than the temperature of said first stage of solution heat treatment; and ageing.

15. A method of making the nickel-based superalloy of claim 6, comprising:

pulverization;

extrusion;

a first stage of solution heat treatment above the gamma-prime solvus;

a second stage of solution heat treatment at a temperature 20°–25° C. lower than the temperature of said first stage of solution heat treatment; and ageing.

16. A method of making the nickel-based superalloy of claim 10, comprising:

pulverization;

extrusion;

a first stage of solution heat treatment above the gamma-prime solvus;

a second stage of solution heat treatment at a temperature 20°–25° C. lower than the temperature of said first stage of solution heat treatment; and ageing.

17. A method of making the nickel-based superalloy of claim 11, comprising:

pulverization;

extrusion;

a first stage of solution heat treatment above the gamma-prime solvus;

a second stage of solution heat treatment at a temperature 20°–25° C. lower than the temperature of said first stage of solution heat treatment; and ageing.

* * * * *

UNITED STATES PATENT AND TRADEMARK OFFICE

CERTIFICATE OF CORRECTION

PATENT NO. : 5,815,792

DATED : September 29, 1998

INVENTOR(S) : Catherine DUQUENNE, et al

It is certified that error appears in the above-identified patent and that said Letters Patent is hereby corrected as shown below:

Column 3, line 40, "2.4k Ti" should read --2.4% Ti--.

Column 4, line 2, "2.5 Ti" should read --2.5% Ti--;
line 9, "OF Cr. Mo. W:GAMMA" should read --OF Cr, Mo, W:GAMMA--;
line 15, "a 25 atomic" should read --a 25% atomic--;
line 42, after the last paragraph and before the Table, insert, --TABLE I--.

Column 4
TABLE I, row Cr, col. A, "011.5 " should read --11.5--;
row V, col. A, delete, --0.9--;
row V, col. G, insert, --0.9--;
row Co, col. NR 4, "14.18 " should read --14.8--;
row Zr, col. NR 4 "0.0 " should read --0.05--;
row B, col. H "0.0514 " should read --0.0515--.

Column 5
TABLE 1 bis, header to left of A and above Cr "blank" should read --%at--;
row %at after Ti+ and before Hf, insert --Nb+--;
row Hf, col. A "0.1 " should read --0.16--;
left-most column "M +" should read --Mo+--.

UNITED STATES PATENT AND TRADEMARK OFFICE

CERTIFICATE OF CORRECTION

PATENT NO. : 5,815,792

DATED : September 29, 1998

INVENTOR(S) : Catherine DUQUENNE, et al

It is certified that error appears in the above-identified patent and that said Letters Patent is hereby corrected as shown below:

Column 7, TABLE II, line 64, row B, col. A "3% should be moved to line 65 to line up with 1000 moy"

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*